United States Patent [19]

Marsden, Jr.

[11] 4,107,566

[45] Aug. 15, 1978

[54] RUGGED QUICK-HEATING ELECTRON TUBES

[75] Inventor: Charles P. Marsden, Jr., Washington, D.C.

[73] Assignee: The United States of America as represented by the Secretaru of the Army, Washington, D.C.

[21] Appl. No.: 486,743

[22] Filed: Feb. 7, 1955

[51] Int. Cl.[2] ..... H01J 1/46; H01J 21/10

[52] U.S. Cl. ..... 313/293; 313/246; 313/310

[58] Field of Search ..... 313/246, 53, 293, 294, 313/282, 292, 310

[56] References Cited

U.S. PATENT DOCUMENTS

| | | | |
|---|---|---|---|
| 2,121,600 | 6/1938 | Knowles et al. | 313/246 |
| 2,391,927 | 1/1946 | Segerstrom, Jr. | 313/293 |
| 2,408,822 | 10/1946 | Tanis, Jr. | 313/246 |
| 2,424,526 | 7/1947 | White | 313/310 |

*Primary Examiner*—Maynard R. Wilbur

*Assistant Examiner*—T. M. Blum

*Attorney, Agent, or Firm*—Nathan Edelberg; Robert P. Gibson; Saul Elbaum

EXEMPLARY CLAIM

1. A rugged combustion-heated electron tube comprising: a metallic conically-shaped anode structure; a metallic conically-shaped cathode structure insulatedly and coaxially mounted in spaced relationship to said anode structure; a metallic conically-shaped grid structure insulatedly and coaxially mounted in spaced relationship between said anode structure and said cathode structure; first and second annular insulating spacer-seals separating said anode structure from said grid structure and said grid structure from said cathode structure, said spacer-seals in combination with said anode structure and said cathode structure providing a hermetically-sealed envelope containing said grid structure; and a combustible material mounted exteriorly of said envelope in proximity to said cathode structure, said combustible material being adapted to heat said cathode structure to an operating temperature.

5 Claims, 1 Drawing Figure

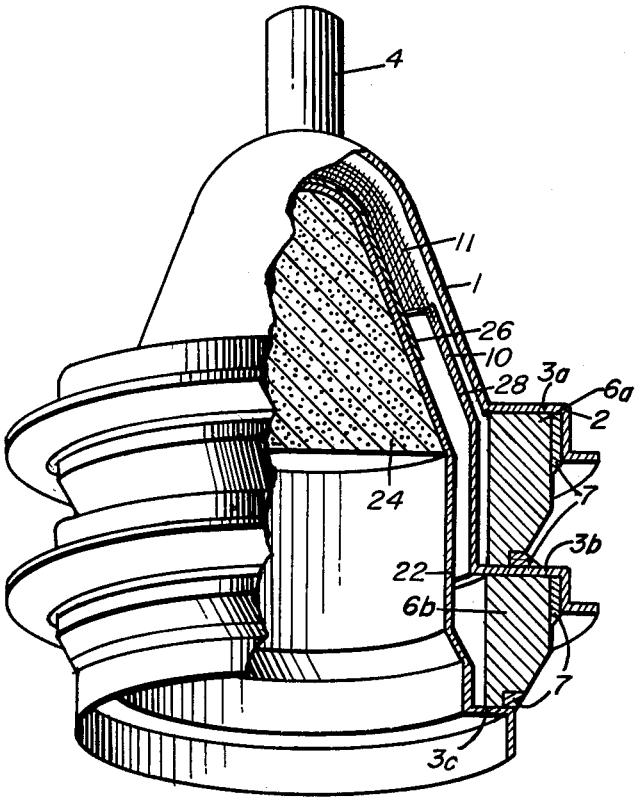
4
11
1
26
10
28
3a
6a
2
24
7
3b
22
6b
7
3c

RUGGED QUICK-HEATING ELECTRON TUBES

The invention described herein may be manufactured and used by or for the Government for governmental purposes without the payment to me of any royalty thereon.

This invention relates to electron tubes. A principal object of the invention is to provide rugged electron tubes, for short-duration expendible use in ordnance projectiles, that (1) have quick-heating cathodes not requiring electrical power and (2) are readily mass-producible at low cost.

Electron tubes for use in ordnance missiles must be extraordinarily rugged. They must be able to withstand the high shock of initial propulsion and must be able to withstand severe vibration encountered in flight without structural failure and without producing excessive output of noise or microphonics. Economy of electrical power consumption is highly desirable.

Other objects, aspects, uses, and advantages of the invention will become apparent from the following description and from the accompanying drawing consisting of one sheet.

The drawing shows a perspective view of a preferred electron tube in accordance with my invention, partly cut away to show internal structure.

In the drawing, the principal features of the tube shown are: a cathode structure 22, a grid structure 10, an anode structure 1, and ceramic spacers 6*a* and 6*b*. Structures 22, 10, and 1 are all of generally similar form, all being metallic and all being of generally dome-like or frusto-conical shape; they are mounted coaxially, electrically insulated from each other and appropriately spaced by annular ceramic spacers 6*a* and 6*b*. Lead seals 7 bond structures 22, 10, and 1 to spacers 6*a* and 6*b*. Structures 22, 10, and 1 preferably have annular flanges 3*c*, 3*b*, and 3*a* respectively for optimum contact with spacers 6*a* and 6*b*. Anode structure 1 and cathode structure 22 are imperforate and, in combination with spacers 6*a* and 6*b* and seals 7, provide a hermetically sealed tube envelope that may be evacuated or filled with a desired gas prior to final sealing.

An anode cap 4 may optionally be provided. Electrical connection to the various electrodes may be made by soldering to external portions thereof.

The main portion 28 of grid structure 10, like structures 1 and 22, is of strong, rigid metal. A perforate apical grid portion 11, consisting preferably of a fine metallic mesh having a low mass per unit area, is fastened to main portion 28, preferably by brazing. This construction results in great immunity to noise and microphonics, even under conditions of severe shock and vibration.

An emissive oxide coating 26 is applied to the part of the surface of cathode structure 22 that faces grid portion 11.

Emissive coating 26 is heated by means of a charge of combustible material 24 mounted externally to the tube envelope in the recess comprising the underside of cathode structure 22. The tube is activated by igniting combustible material 24, which consists preferably of a well-known composition based on ferric oxide and aluminum. Powdered nickel, or other material, may be included in the combustible mixture as a combustion retardant to extend the combustion time. It will be understood that ignition can be readily accomplished in various ways.

I prefer to assemble my tubes by stacking the elements in an inverted position. Anode 1, with its apex downward, is at the bottom of the stack, and the other elements rest on top of it, held in place by gravity during assembly. Various ceramic-to-metal sealing techniques are known. In accordance with one known technique, I prefer to coat with titanium hydride those areas of spacers 6*a* and 6*b* to which it is desired that lead seals 7 adhere. In the assembly operation lead seals 7 are preferably initially in the form of solid rings that are positioned with the other components. After all components are positioned the entire stack is heated in vacuum — preferably in an induction furnace — to above the decomposition point of titaniumhydride (which point is higher than the melting point of lead) and then cooled. This technique gives a ruggedly bonded and hermetically sealed structure. Combustible material 24 is positioned after cooling. An important advantage of my invention is that the fabrication of my tubes — forming of the various elements, stacking, and heat-sealing in vacuum — can readily be made completely automatic. Tubes in accordance with my invention can thus be mass produced at very low cost.

In typical ordnance fuze applications, electron tubes must be quickly activated but need remain active for only a matter of seconds. In one subminiature tube constructed in accordance with my invention the cathode reached operating temperature within 2 seconds of ignition of the combustible material and remained at a full operating level for about 16 seconds. An unreasonably large amount of electrical power would be required to obtain the same quick heating of a cathode as rugged as that provided in my invention.

From what has been said it will be seen that my tube combines extraordinary ruggedness with quick, economical cathode heating and with ready adaptability to rapid and economical mass construction.

Certain of the features described above are similar to those described in my copending application Ser. No. 308,175 filed Sept. 5, 1952.

It will be apparent that the embodiments shows are only exemplary and that various modifications can be made in construction and arrangement within the scope of the invention as defined in the appended claims.

I claim:

1. A rugged combustion-heated electron tube comprising: a metallic conically-shaped anode structure; a metallic conically-shaped cathode structure insulatedly and coaxially mounted in spaced relationship to said anode structure; a metallic conically-shaped grid structure insulatedly and coaxially mounted in spaced relationship between said anode structure and said cathode structure; first and second annular insulating spacer-seals separating said anode structure from said grid structure and said grid structure from said cathode structure, said spacer-seals in combination with said anode structure and said cathode structure providing a hermetically-sealed envelope containing said grid structure; and a combustible material mounted exteriorly of said envelope in proximity to said cathode structure, said combustible material being adapted to heat said cathode structure to an operating temperature.

2. The invention according to claim 1 in which said grid structure comprises a metallic grid mesh of relatively small mass per unit area fused to the open apical end of a rigid frusto-conical metallic support.

3. A rugged combustion-heated electron tube comprising: metallic cathode, grid, and anode structures, each of said structures being generally dome-shaped and having an annular flange extending outward from the base of the structure, the planes of the flanges being perpendicular to the axes of the structures, said structures being positioned coaxially with their apices in the same direction, the anode structure being in the apical direction with respect to the cathode structure, the grid structure being between the cathode and anode structures; annular insulating spacer-seals between the flanges of said cathode and grid structures and between the flanges of said grid and anode structures, said spacer-seals in combination with said structures providing a hermetically sealed envelope containing said grid structure; and a charge of combustible material positioned exteriorly of said envelope in proximity to the concave side of said cathode structure, said combustible material being adapted upon ignition to heat said cathode structure to an operating temperature.

4. The invention according to claim 3, said grid structure comprising a metallic grid mesh of relatively small mass per unit area fused to the open apical end of a rigid frusto-conical metallic support.

5. The invention according to claim 4, said spacer-seals consisting of ceramic bodies sealed with lead to said flanges.

* * * * *